US011421947B2

(12) United States Patent
Matsui et al.

(10) Patent No.: US 11,421,947 B2
(45) Date of Patent: Aug. 23, 2022

(54) LAMINATED HEADER, HEAT EXCHANGER, AND AIR-CONDITIONING APPARATUS

(71) Applicant: Mitsubishi Electric Corporation, Tokyo (JP)

(72) Inventors: Shigeyoshi Matsui, Tokyo (JP); Shinya Higashiiue, Tokyo (JP); Takehiro Hayashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 102 days.

(21) Appl. No.: 15/748,759

(22) PCT Filed: Sep. 7, 2015

(86) PCT No.: PCT/JP2015/075351

§ 371 (c)(1),
(2) Date: Jan. 30, 2018

(87) PCT Pub. No.: WO2017/042867

PCT Pub. Date: Mar. 16, 2017

(65) Prior Publication Data

US 2019/0170456 A1 Jun. 6, 2019

(51) Int. Cl.
*F28F 9/02* (2006.01)
*F25B 41/00* (2021.01)
(Continued)

(52) U.S. Cl.
CPC ..... *F28F 9/0278* (2013.01); *F25B 39/022* (2013.01); *F25B 39/04* (2013.01);
(Continued)

(58) Field of Classification Search
CPC ..... F25B 39/02; F25B 39/022; F25B 39/04; F25B 41/00; F25B 41/003; F25B 41/06;
(Continued)

(56) References Cited

U.S. PATENT DOCUMENTS 2,734,224 A 2/1956 Winstead
4,309,987 A * 1/1982 Higgins, Jr. ..... F28F 9/026 126/664

(Continued)

FOREIGN PATENT DOCUMENTS

JP 05264126 A * 10/1993
JP H09-189463 A 7/1997
WO 2014/184914 A1 11/2014

OTHER PUBLICATIONS

ASHRAE 2008 Handbook—HVAC Systems and equipment, pp. 22.5 and 26.3 (Year: 2008).*

(Continued)

*Primary Examiner* — Len Tran
*Assistant Examiner* — Gustavo A Hincapie Serna
(74) *Attorney, Agent, or Firm* — Posz Law Group, PLC

(57) ABSTRACT

A laminated header includes: a first passage plate having a flat-plate shape in which a first passage is formed; a second passage plate having a flat-plate shape in which a plurality of second passages are formed; a third passage plate having a flat-plate shape in which a plurality of third passages are formed; a first branch passage plate having a flat-plate shape in which an upstream side branch passage is formed, the upstream side branch passage branching the first passage into the plurality of second passages; and a second branch passage plate having a flat-plate shape in which a downstream side branch passage is formed, the downstream side branch passage branching one of the plurality of second passages into the plurality of third passages.

16 Claims, 5 Drawing Sheets

(51) Int. Cl.

| | |
|---|---|
| ***F25B 39/02*** | (2006.01) |
| ***F25B 39/04*** | (2006.01) |
| ***F28F 1/10*** | (2006.01) |
| ***F28F 3/08*** | (2006.01) |

(52) U.S. Cl.
CPC ..... *F25B 41/00* (2013.01); *F28F 1/10* (2013.01); *F28F 3/08* (2013.01); *F28F 9/02* (2013.01); *F28F 9/0221* (2013.01); *F28F 9/0263* (2013.01); *F28F 9/0275* (2013.01); *F28F 2009/0292* (2013.01); *F28F 2009/0295* (2013.01)

(58) Field of Classification Search
CPC ..... F28F 1/10; F28F 3/08; F28F 9/02; F28F 9/0221; F28F 9/0263; F28F 9/0273; F28F 9/0275; F28F 9/0278; F28F 2009/0292; F28F 2009/0295
USPC ..... 165/96, 143, 172, 173, 174, 175, 176; 62/504, 525, 527
See application file for complete search history.

(56) References Cited

U.S. PATENT DOCUMENTS

| | | | | |
|---|---|---|---|---|
| 4,502,297 | A * | 3/1985 | Winterer | F28F 9/0278 62/515 |
| 5,241,839 | A | 9/1993 | Hughes | |
| 5,242,016 | A * | 9/1993 | Voss | F25B 39/028 165/173 |
| 5,806,586 | A * | 9/1998 | Osthues | F28F 9/0273 165/153 |
| 5,992,453 | A | 11/1999 | Zimmer | |
| 6,616,327 | B1 * | 9/2003 | Kearney | B01F 5/06 366/340 |
| 6,892,805 | B1 * | 5/2005 | Valensa | F28F 9/0278 165/173 |
| 7,275,394 | B2 * | 10/2007 | Lundberg | F28D 1/05391 165/DIG. 483 |
| 7,908,126 | B2 * | 3/2011 | Bahel | G06F 17/5009 700/276 |
| 8,171,987 | B2 * | 5/2012 | Jiang | F28F 9/0273 165/174 |
| 9,159,645 | B2 * | 10/2015 | Mori | H01L 23/473 |
| 10,563,895 | B2 * | 2/2020 | Mislak | F28F 9/0278 |
| 2002/0080563 | A1 * | 6/2002 | Pence | B01F 5/06 361/676 |
| 2003/0079863 | A1 * | 5/2003 | Sugito | H05K 7/1418 257/E23.098 |
| 2003/0188857 | A1 * | 10/2003 | Kawakubo | F28D 1/0476 165/174 |
| 2005/0039901 | A1 * | 2/2005 | Demuth | F28D 1/0478 165/175 |
| 2007/0119431 | A1 * | 5/2007 | Harada | F02B 29/0456 123/563 |
| 2007/0251682 | A1 * | 11/2007 | Sasaki | F28D 1/0391 165/153 |
| 2014/0202672 | A1 * | 7/2014 | Goenka | F28F 9/02 165/173 |
| 2016/0076823 | A1 * | 3/2016 | Okazaki | F28F 9/0221 165/174 |
| 2016/0076824 | A1 * | 3/2016 | Matsuda | F28F 9/0278 165/174 |
| 2016/0116231 | A1 * | 4/2016 | Higashiiue | F28F 9/02 165/174 |
| 2016/0169595 | A1 * | 6/2016 | Matsuda | F28F 9/0221 165/104.21 |
| 2016/0195335 | A1 * | 7/2016 | Nishiyama | F28D 1/05366 165/174 |
| 2016/0202000 | A1 * | 7/2016 | Higashiiue | F28F 9/0275 165/104.21 |
| 2017/0241684 | A1 * | 8/2017 | Ito | F25B 13/00 |
| 2017/0328652 | A1 * | 11/2017 | Matsui | F28D 1/05366 |

OTHER PUBLICATIONS

JPH05264126A Machine Translation attached (Year: 1993).*
International Search Report of the International Searching Authority dated Nov. 24, 2015 for the corresponding international application No. PCT/JP2015/075351 (and English translation).

* cited by examiner

A-A CROSS-SECTIONAL VIEW B-B CROSS-SECTIONAL VIEW

A-A CROSS-SECTIONAL VIEW

B-B CROSS-SECTIONAL VIEW

LAMINATED HEADER, HEAT EXCHANGER, AND AIR-CONDITIONING APPARATUS

CROSS REFERENCE TO RELATED APPLICATION

This application is a U.S. national stage application of PCT/JP2015/075351 filed on Sep. 7, 2015, the contents of which are incorporated herein by reference.

TECHNICAL FIELD

The present invention relates to a laminated header, a heat exchanger, and an air-conditioning apparatus that are used in, for example, a heat circuit.

BACKGROUND ART

A conventionally known distributor (laminated header) distributes fluid into heat transfer tubes of a heat exchanger. In such a distributor, a plurality of plate members each including a branch passage that branches into a plurality of exit passages from one entrance passage are stacked to distribute fluid into the heat transfer tubes of the heat exchanger (see Patent Literature 1, for example).

CITATION LIST

Patent Literature

Patent Literature 1: Japanese Patent Laid-open No. 9-189463 (see FIG. 1, for example)

SUMMARY OF INVENTION

Technical Problem

In such a distributor (laminated header), the ratio of the flow of liquid fluid flowing out of the plurality of exit passages, which is referred to as a distribution ratio, needs to be maintained uniform to uniformly supply fluid to the heat transfer tubes of the heat exchanger. This is important to achieve the performance of the heat exchanger functioning as an evaporator.

When the conventional distributor is used in such a state that the gravitational force applies in the branching direction of branch passages, a larger amount of liquid fluid flows to one of the branch passages. As a result, the liquid fluid ununiformly flows out of the plurality of exit passages of the distributor and is ununiformly supplied to the heat transfer tubes of the heat exchanger. This degrades the heat exchange performance of the heat exchanger.

The present invention is intended to solve the above-described problem and provide a distributor (laminated header) capable of uniformly distributing fluid to heat transfer tubes of a heat exchanger to achieve the heat exchange performance of the heat exchanger. The present invention is also intended to provide a heat exchanger including such a distributor (laminated header). The present invention is also intended to provide an air-conditioning apparatus including such a heat exchanger.

Solution to Problem

A laminated header according to an embodiment of the present invention includes: a first passage plate having a flat-plate shape in which a first passage is formed; a second passage plate having a flat-plate shape in which a plurality of second passages are formed; a third passage plate having a flat-plate shape in which a plurality of third passages are formed; a first branch passage plate having a flat-plate shape in which an upstream side branch passage is formed, the upstream side branch passage branching the first passage into the plurality of second passages; and a second branch passage plate having a flat-plate shape in which a downstream side branch passage is formed, the downstream side branch passage branching one of the plurality of second passages into the plurality of third passages. The first passage plate, the first branch passage plate, the second passage plate, the second branch passage plate, and the third passage plate are stacked in this order. A first cross-sectional area as a maximum value of a passage cross-sectional area of the upstream side branch passage is larger than a second cross-sectional area as a maximum value of a passage cross-sectional area of the downstream side branch passage.

Advantageous Effects of Invention

In a laminated header according to an embodiment of the present invention, the flow of fluid decreases through branching into branch passages, but a flow speed equal to or larger than a certain value can be maintained in each branch passage. Specifically, the flow speed of the fluid is increased by further reducing the passage cross-sectional area of a branch passage positioned further downstream while the maximum passage cross-sectional area of a branch passage is set to be equal to or smaller than the maximum passage cross-sectional area of a branch passage positioned upstream thereof. Accordingly, the influence of the gravitational force on a liquid component of the fluid can be reduced to prevent accumulation of a liquid film, thereby achieving a uniform distribution ratio through a branch passage.

DESCRIPTION OF EMBODIMENTS

Figure 1:
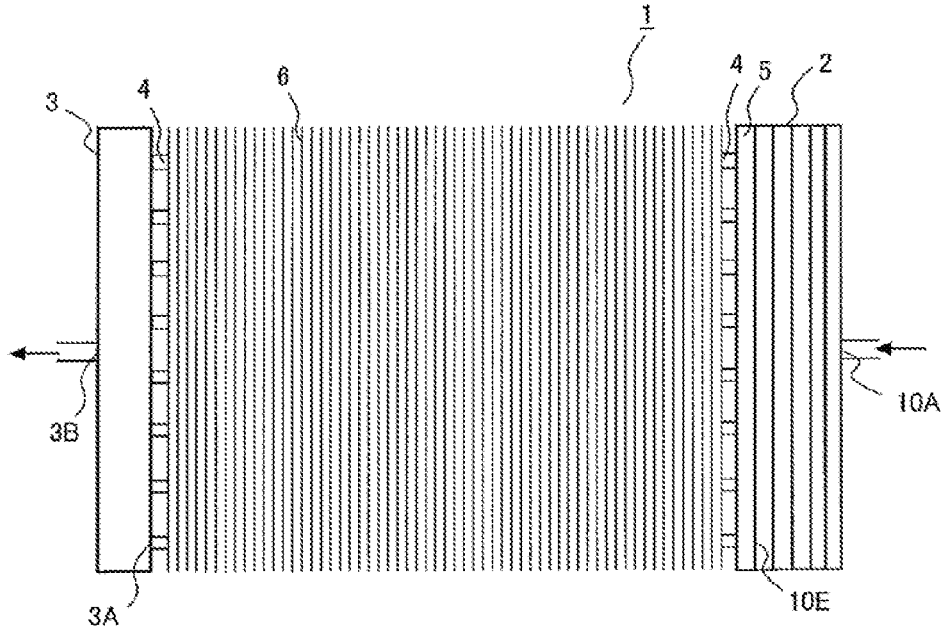
FIG. 1 is a diagram illustrating the configuration of a heat exchanger according to Embodiment 1.

The following describes a laminated header, a heat exchanger, and an air-conditioning apparatus according to the present invention with reference to the accompanying drawings.

Configurations, operations, and the like to be described below are merely exemplary, and do not limit the laminated header, the heat exchanger, and the air-conditioning apparatus according to the present invention. In the drawings, any identical or equivalent component is denoted by an identical reference sign or no reference sign. Illustration of any small structure is simplified or omitted as appropriate. Any duplicate or equivalent description is simplified or omitted as appropriate.

The following description is made on a case in which the laminated header and the heat exchanger according to the present invention are applied to an air-conditioning apparatus, but the present invention is not limited to such a case. For example, the laminated header and the heat exchanger according to the present invention may be applied to any other refrigeration cycle device including a refrigerant cycle circuit. Refrigerant capable of performing phase transition is used as a heat medium in the description, but fluid not capable of performing phase transition may be used. The following description is made on a case in which the laminated header and the heat exchanger according to the present invention are included in an outdoor heat exchanger of an air-conditioning apparatus, but the present invention is not limited to such as case. The laminated header and the heat exchanger according to the present invention may be included in an indoor heat exchanger of the air-conditioning apparatus. The following description is made on a case in which the air-conditioning apparatus is capable of switching between a heating operation and a cooling operation, but the present invention is not limited to such a case. The air-conditioning apparatus may perform the heating operation or the cooling operation only.

Embodiment 1

The following describes a laminated header, a heat exchanger, and an air-conditioning apparatus according to Embodiment 1.

<Configuration of Heat Exchanger 1>

The configuration of the heat exchanger according to Embodiment 1 will be described below.

FIG. 1 is a diagram illustrating the configuration of a heat exchanger 1 according to Embodiment 1.

As illustrated in FIG. 1, the heat exchanger 1 includes a laminated header 2, a cylindrical header 3, a plurality of heat transfer tubes 4, a holder 5, and a plurality of fins 6.

The laminated header 2 includes one first passage 10A and a plurality of fifth passages 10E. The cylindrical header 3 includes a plurality of first passages 3A and one second passage 3B. The first passage 10A of the laminated header 2 and the second passage 3B of the cylindrical header 3 are each connected with a refrigerant pipe of a refrigeration cycle device. The fifth passages 10E of the laminated header 2 are connected with the first passages 3A of the cylindrical header 3 through the heat transfer tubes 4.

The heat transfer tubes 4 are flat or circular tubes in which a plurality of passages are formed. The heat transfer tubes 4 are made of, for example, copper or aluminum. An end part of each heat transfer tube 4, which is closer to the laminated header 2 is connected with the corresponding fifth passage 10E of the laminated header 2 while being held by the holder 5 having a plate shape. The holder 5 is made of, for example, aluminum. The heat transfer tubes 4 are joined with the plurality of fins 6. The fins 6 are made of, for example, aluminum. Although FIG. 1 illustrates a case in which the eight heat transfer tubes 4 are provided, the present invention is not limited to such a case. For example, the number of heat transfer tubes 4 may be two.

<Refrigerant Flow in Heat Exchanger>

The following describes refrigerant flow in the heat exchanger 1 according to Embodiment 1.

For example, when the heat exchanger 1 functions as an evaporator, refrigerant flowing through the refrigerant pipe flows into the laminated header 2 through the first passage 10A and is distributed, and then flows out to the plurality of the heat transfer tubes 4 through the plurality of fifth passages 10E. In the plurality of heat transfer tubes 4, the refrigerant exchanges heat with, for example, air supplied by an air-sending device. The refrigerant flowing through the plurality of heat transfer tubes 4 flows into the cylindrical header 3 through the plurality of first passages 3A and joins together, and then flows out to the refrigerant pipe through the second passage 3B. When the heat exchanger 1 functions as a condenser, the refrigerant flows oppositely to the above-described flow.

<Configuration of Laminated Header>

The following describes the configuration of the laminated header 2 of the heat exchanger 1 according to Embodiment 1.

Figure 2:
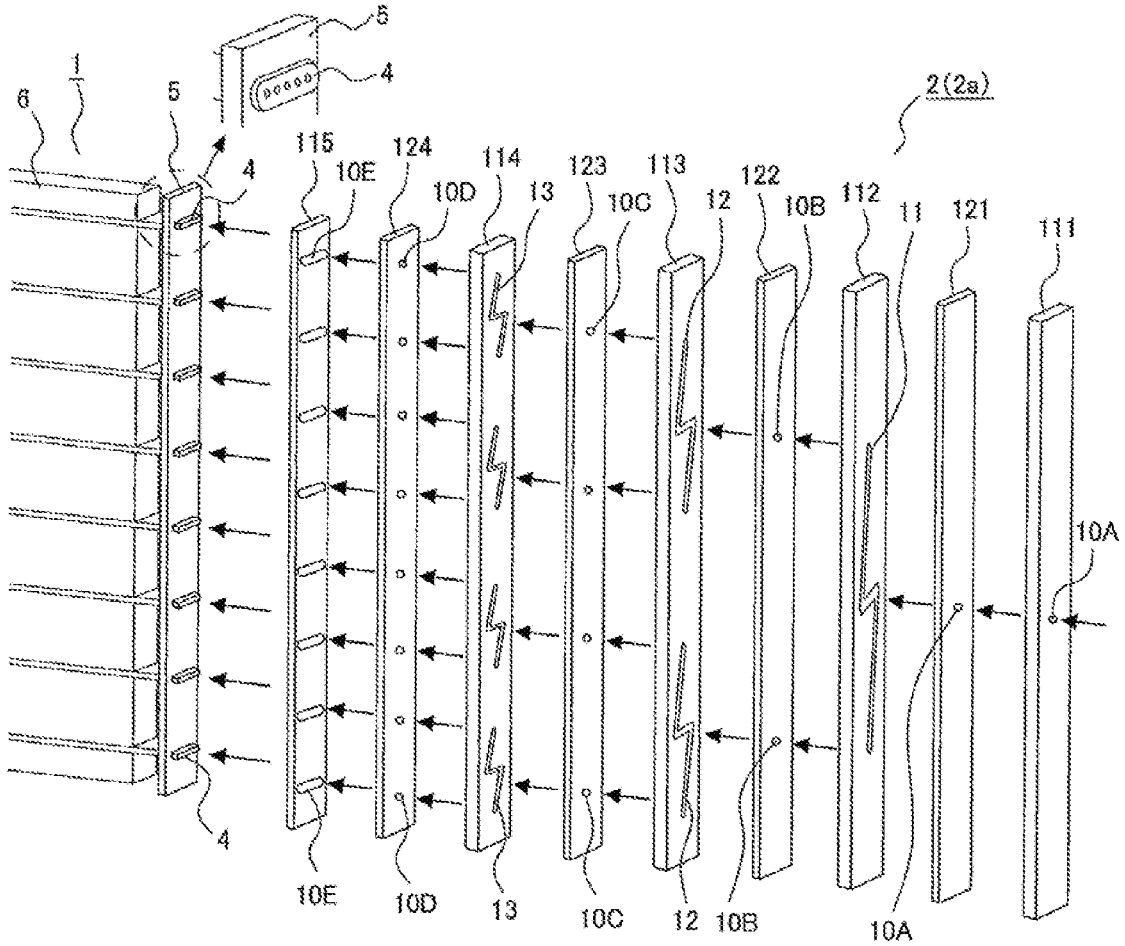
FIG. 2 is an exploded perspective view of a laminated header according to Embodiment 1.

FIG. 2 is an exploded perspective view of the laminated header according to Embodiment 1.

The laminated header 2 (distributor) illustrated in FIG. 2 includes first plate bodies 111, 112, 113, 114, and 115 having, for example, rectangular shapes, and second plate bodies 121, 122, 123, and 124 sandwiched between the first plate bodies. The first plate bodies 111, 112, 113, 114, and 115 and the second plate bodies 121, 122, 123, and 124 have profiles in identical shapes in plan view.

For example, before brazing, no brazing filler metal is cladded (applied) on the first plate bodies 111, 112, 113, 114, and 115, but brazing filler metal is cladded (applied) on both or one of surfaces of each of the second plate bodies 121, 122, 123, and 124.

In this state, the first plate bodies 111, 112, 113, 114, and 115 are stacked with the second plate bodies 121, 122, 123, and 124 interposed therebetween and are brazed through heating in a heating furnace. The first plate bodies 111, 112, 113, 114, and 115 and the second plate bodies 121, 122, 123, and 124 each have, for example, a thickness of 1 to 10 mm approximately and are made of aluminum.

The holder 5 is a plate member holding the end parts of the heat transfer tubes 4 of the heat exchanger 1. The holder 5 has a profile in a shape identical to those of the first plate bodies 111, 112, 113, 114, and 115, the second plate bodies 121, 122, 123, and 124 in plain view. The holder 5 is brazed with the heat transfer tubes 4. When the holder 5 and the first plate body 115 are stacked, the heat transfer tubes 4 are connected with the fifth passages 10E in the first plate body 115. The heat transfer tubes 4 may be directly connected with the fifth passages 10E in the first plate body 115 without the holder 5. This configuration leads to, for example, reduction in component cost.

Each plate body is fabricated by pressing or machining. A plate material to be fabricated by pressing may be have a thickness equal to or smaller than 5 mm, which is sufficient to allow pressing. A plate material to be fabricated by machining may have a thickness equal to or larger than 5 mm.

(Configuration of Distributing/Joining Passage 2*a*)

The laminated header 2 includes a distributing/joining passage 2*a* formed by passages formed in the first plate bodies 111, 112, 113, 114, and 115 and the second plate bodies 121, 122, 123, and 124. The distributing/joining passage 2*a* includes the first passage 10A, second passages 10B, third passages 10C, fourth passages 10D, and the fifth passages 10E, which are circular through-holes, a first branch passage 11, second branch passages 12, and third branch passages 13, which are substantially S-shaped or substantially Z-shaped through-grooves.

The first passage 10A is circularly opened substantially at the center each of the first plate body 111 and the second plate body 121 (corresponding to a first passage plate according to the present invention). In the second plate body 122 (corresponding to a second passage plate according to the present invention) being stacked, the pair of second passages 10B are circularly opened at positions symmetric with respect to the first passage 10A.

In the second plate body 123 (corresponding to a third passage plate according to the present invention) being stacked, the four third passages 10C are circularly opened at positions symmetric with respect to the respective second passages 10B.

In the second plate body 124 being stacked, the eight fourth passages 10D are circularly opened at positions symmetric with respect to the respective third passages 10C.

The fifth passages 10E are opened at the first plate body 115. The fifth passages 10E are communicated with the fourth passages 10D and formed to have shapes same as those of the profiles of the heat transfer tubes 4. The fifth passages 10E are communicated with the heat transfer tubes 4.

The one first branch passage 11 (corresponding to an upstream side branch passage according to the present invention) as a substantially S-shaped or substantially Z-shaped through-groove is formed in the first plate body 112 (corresponding to a first branch passage plate according to the present invention). Similarly, the two second branch passages 12 (corresponding to a downstream side branch passage according to the present invention) as a substantially S-shaped or substantially Z-shaped through-groove are formed in the first plate body 113 (corresponding to a second branch passage plate according to the present invention). Similarly, the four third branch passages 13 as a substantially S-shaped or substantially Z-shaped through-groove are formed in the first plate body 114.

When the plate bodies are stacked to form the distributing/joining passage 2*a*, the first branch passage 11 formed in the first plate body 112 is connected with the first passage 10A at the center thereof and connected with the second passages 10B at both end parts thereof.

The second branch passages 12 formed in the first plate body 113 is connected with the second passages 10B at the center thereof and connected with the third passages 10C at both end parts thereof.

The third branch passages 13 formed in the first plate body 114 is connected with the third passages 10C at the center thereof and connected with the fourth passages 10D at both end parts thereof. The fourth passages 10D are connected with the fifth passages 10E.

In this manner, the first plate bodies 111, 112, 113, 114, and 115 and the second plate bodies 121, 122, 123, and 124 are stacked and brazed to connect the passages, thereby forming the distributing/joining passage 2*a*.

(Configurations of First Branch Passage 11, Second Branch Passages 12, and Third Branch Passages 13)

Figure 3:
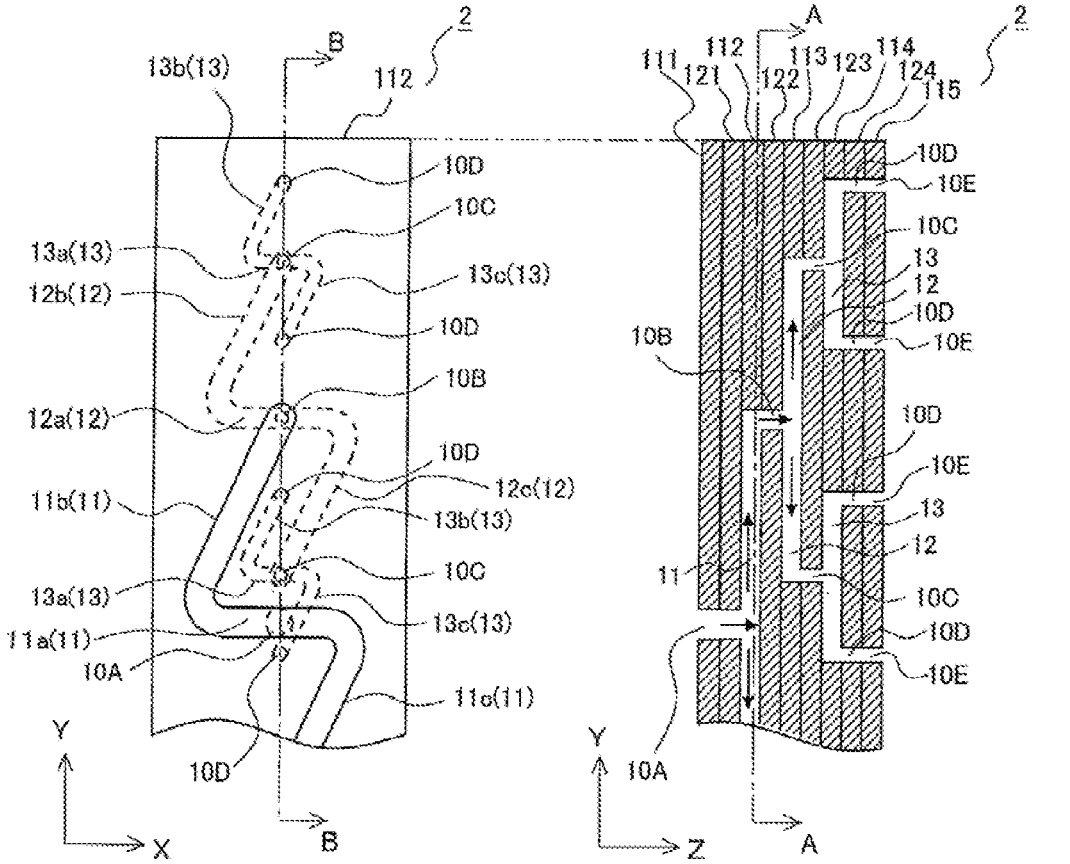
FIG. 3 is an A-A cross-sectional view and a B-B cross-sectional view of a laminated header 2, illustrating the structures of branch passages according to Embodiment 1.

The following describes the structures of the first branch passage 11, the second branch passages 12, and the third branch passages 13 in detail with reference to FIG. 3.

FIG. 3 is an A-A cross-sectional view and a B-B cross-sectional view of the laminated header 2, illustrating the structures of the branch passages according to Embodiment 1.

The first branch passage 11 is a single substantially S-shaped or substantially Z-shaped through-groove formed in the first plate body 112 as described above. The first branch passage 11 includes a first branch part 11*a* opened and extending in a transverse direction (X direction in FIG. 3) of the first plate body 112, and two parts, an upper second branch part 11*b* and a lower second branch part 11*c*, opened and extending in a longitudinal direction (Y direction in FIG. 3) of the first plate body 112 from both ends of the first branch part 11*a*.

The first branch part 11*a* is smoothly connected with the upper second branch part 11*b* and the lower second branch part 11*c* through bent parts. When the laminated header 2 is used, the Y direction in FIG. 3 is aligned with the direction of gravitational force. In this state, the first branch part 11*a* extends in the horizontal direction (X direction in FIG. 3). The upper second branch part 11*b* extends upward from one end of the first branch part 11*a*. The lower second branch part 11*c* extends downward from the other end of the first branch part 11*a*.

The second branch passages 12 are two substantially S-shaped or substantially Z-shaped through-grooves formed in the first plate body 113 as described above. The second branch passages 12 includes a first branch part 12*a* opened and extending in a transverse direction (the X direction in FIG. 3) of the first plate body 113, and two parts, an upper second branch part 12*b* and a lower second branch part 12*c*, opened and extending in a longitudinal direction (the Y direction in FIG. 3) of the first plate body 113 from both ends of the first branch part 12*a*.

The first branch part 12*a* is smoothly connected with the upper second branch part 12*b* and the lower second branch part 12*c* through bent parts. When the laminated header 2 is used, the Y direction in FIG. 3 is aligned with the direction of gravitational force. In this state, the first branch part 12*a* extends in the horizontal direction (X direction in FIG. 3). The upper second branch part 12*b* extends upward from one end of the first branch part 12*a*. The lower second branch part 12*c* extends downward from the other end of the first branch part 12*a*.

The third branch passages 13 are four substantially S-shaped or substantially Z-shaped through-grooves formed in the first plate body 114 as described above. The third branch passages 13 includes a first branch part 13*a* opened and extending a transverse direction (the X direction in FIG. 3) of the first plate body 114, and two parts, an upper second branch part 13*b* and a lower second branch part 13*c*, opened and extending in a longitudinal direction (the Y direction in FIG. 3) of the first plate body 114 from both ends of the first branch part 13*a*.

The first branch part 13*a* is smoothly connected with the upper second branch part 13*b* and the lower second branch part 13*c* through bent parts. When the laminated header 2 is used, the Y direction in FIG. 3 is aligned with the direction of gravitational force. In this state, the first branch part 13*a* extends in the horizontal direction (X direction in FIG. 3). The upper second branch part 13*b* extends upward from one end of the first branch part 13*a*. The lower second branch part 13*c* extends downward from the other end of the first branch part 13*a*.

The passage cross-sectional areas of the first branch passage 11, each second branch passage 12, and each third branch passage 13 decrease in this order.

The passage cross-sectional areas of the first branch passage 11, each second branch passage 12, and each third branch passage 13 illustrated in FIG. 3 are constant therethrough.

<Refrigerant Flow in Laminated Header 2>

The following describes refrigerant flow through the distributing/joining passage 2*a* in the laminated header 2.

In the following, upstream and downstream sides of the distributing/joining passage 2*a* are exemplary defined for a case in which the heat exchanger 1 functions as an evaporator.

First, two-phase gas-liquid refrigerant flows into the laminated header 2 through the first passage 10A of the first plate body 111. Having flowed into the laminated header 2, the refrigerant travels straight inside the first passage 10A before colliding with the surface of the second plate body 122 in the first branch passage 11 of the first plate body 112, and then separately flows at the first branch part 11*a* of the first branch passage 11 in the horizontal direction with respect to the direction of gravitational force. Having traveled to both ends of the first branch part 11*a*, the refrigerant travels upward in the direction of gravitational force inside the upper second branch part 11*b*, and also travels downward in the direction of gravitational force inside the lower second branch part 11*c*. Then, the refrigerant flows into the pair of second passages 10B.

Having flowed into the second passages 10B, the refrigerant travels straight inside the second passages 10B in directions identical to those of the refrigerant traveling inside the first passage 10A. The refrigerant collides with the surface of the second plate body 123 in the second branch passages 12 of the first plate body 113, and separately flows in the horizontal direction with respect to the direction of gravitational force at the first branch part 12*a* of each second branch passage 12. Having traveled to both ends of the first branch part 12*a*, the refrigerant travels upward in the direction of gravitational force inside the upper second branch part 12*b*, and also travels downward in the direction of gravitational force inside the lower second branch part 12*c*. Then, the refrigerant flows into the four third passages 100.

Having flowed into the third passages 100, the refrigerant travels straight inside the third passages 10C in directions identical to those of the refrigerant traveling inside the second passages 10B. The refrigerant collides with the surface of the second plate body 124 in the third branch passages 13 of the first plate body 114, and separately flows in the horizontal direction with respect to the direction of gravitational force at the first branch part 13*a* of each third branch passage 13. Having traveled to both ends of the first branch part 13*a*, the refrigerant travels upward in the direction of gravitational force inside the upper second branch part 13*b*, and also travels downward in the direction of gravitational force inside the lower second branch part 13*c*. Then, the refrigerant flows into the eight fourth passages 10D.

Having flowed into the fourth passages 10D, the refrigerant travels in directions identical to those of the refrigerant traveling inside the third passages 10C and flows into the fifth passages 10E. Then, having flowed out of the fifth passages 10E, the refrigerant flows into the plurality of heat transfer tubes 4 held by the holder 5 in a uniformly distributed manner.

In the distributing/joining passage 2*a* of the laminated header 2 according to Embodiment 1, the refrigerant is divided into eight branches through three branch passages, but the number of times of branching and the number of branch passages are not limited to those exemplary values.

(Accumulation of Liquid Refrigerant in Branch Passage)

Figure 4:
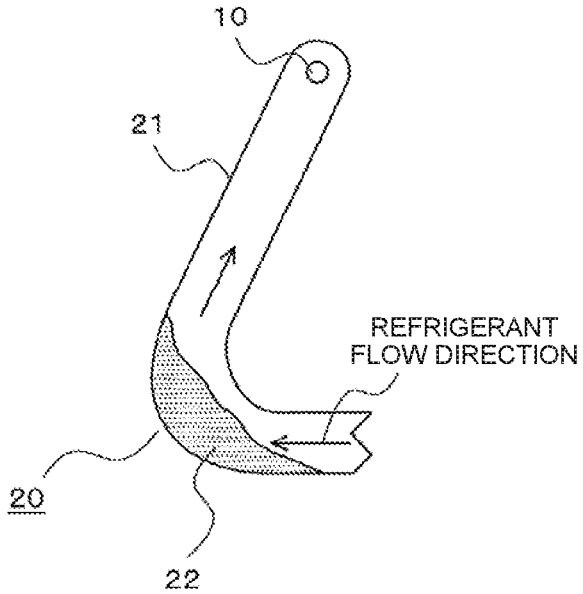
FIG. 4 is an explanatory diagram illustrating a state inside a branch passage in a distributor according to a comparative example.

The following describes accumulation of liquid refrigerant in a branch passage with reference to FIG. 4.

FIG. 4 is an explanatory diagram illustrating a state inside a branch passage in a distributor according to a comparative example.

In this branch passage 20, the speed of refrigerant flowing to a passage 10 upward in the direction of gravitational force decreases at an upper branch part 21. As a result, a liquid film 22 accumulates in the branch passage 20 as illustrated in FIG. 4. The accumulation of the liquid film 22 leads to reduction of an effective passage area through which the refrigerant flows, thereby increasing a pressure loss through the passage extending upward in the direction of gravitational force. Accordingly, the refrigerant has an ununiform distribution ratio in the branch passage 20.

In a laminated header according to the comparative example, multi-branching is achieved through repeated branching into a plurality of branch passages having equal passage cross-sectional areas. Thus, the refrigerant flowing through a further downstream branch passage has a lower flow speed and is more likely to have accumulation of a liquid film under influence of the gravitational force on a liquid component.

However, since the passage cross-sectional areas of the first branch passage 11, the second branch passages 12, and the third branch passages 13 according to Embodiment 1 decrease in this order, the flow of the refrigerant decreases through branching into the branch passages but a flow speed equal to or larger than a certain value can be maintained in each branch passage.

In other words, the flow speed of the refrigerant is increased by further reducing the passage cross-sectional area of a branch passage positioned further downstream while the maximum passage cross-sectional area of the branch passage is set to be equal to or smaller than the maximum passage cross-sectional area of a branch passage positioned upstream thereof. Accordingly, the influence of the gravitational force on the liquid component can be reduced to prevent accumulation of a liquid film, thereby achieving a uniform distribution ratio through a branch passage.

(Necessary Flow Speed of Refrigerant in Each Branch Passage)

Figure 5:
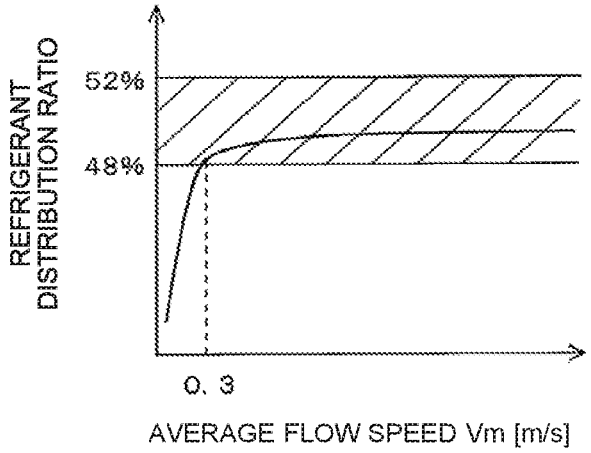
FIG. 5 illustrates the relation between an average flow speed Vm of refrigerant at the entrance of a branch passage according to Embodiment 1 and a distribution ratio of the refrigerant in the branch passage.

The following describes a necessary flow speed of the refrigerant in each branch passage with reference to FIG. 5.

FIG. 5 illustrates the relation between an average flow speed Vm of the refrigerant at the entrance of a branch passage according to Embodiment 1 and the distribution ratio of the refrigerant within the branch passage.

An ununiform distribution ratio degrades heat exchange performance of the heat exchanger 1, and thus the distribution ratio in a branch passage branching into two has an allowable range of 48% to 52% inclusive approximately. As illustrated in FIG. 5, the accumulation of liquid films in the upper second branch parts 11*b*, 12*b*, and 13*b*, in particular, can be prevented by setting the average flow speed Vm of the refrigerant to be equal to or higher than 0.3 [m/s] at the entrance of each of the first branch passage 11, the second branch passages 12, and the third branch passages 13, thereby achieving the distribution ratio of the refrigerant in the allowable range. The average flow speed Vm of the refrigerant is calculated by Expressions (1) and (2) below on assumption of homogenous flow.

When x represents the quality of the refrigerant, $\rho_L$ [kg/m$^3$] represents the saturated liquid density of the refrigerant, and $\rho_G$ [kg/m$^3$] represents the saturated gas density of the refrigerant, the saturated density $\rho_{ave}$ of the refrigerant is calculated by Expression (1).

[Expression 1]

$$\frac{1}{\rho_{ave}} = \frac{x}{\rho_L} + \frac{1-x}{\rho_G} \tag{1}$$

When Gr [kg/s] represents a minimum refrigerant flow flowing into the laminated header 2, n represents the number of branch passages branching upstream of a branch passage as a calculation target, An [m$^2$] represents the maximum passage cross-sectional area of the branch passage as the calculation target, and $\rho_{ave}$ [kg/m$^3$] represents the saturated density of the refrigerant, a necessary refrigerant average flow speed [m/s] is calculated by Expression (2).

[Expression 2]

$$v_m = \frac{Gr}{n \cdot \rho_{ave} \cdot A_n} \tag{2}$$

Accordingly, the maximum passage cross-sectional area An [m$^2$] of a branch passage for which Vm≥0.3 [m/s] is satisfied is determined by Expression (3) below.

[Expression 3]

$$A_n \leqq \frac{Gr}{0.3\ n\rho_{ave}} = \frac{Gr}{0.3\ n}\left(\frac{x}{\rho_G} + \frac{1-x}{\rho_L}\right) \tag{3}$$

It is preferable to set such a passage cross-sectional area that achieves Vm≥0.3 [m/s] in each of the first branch passage 11, the second branch passages 12, and the third branch passages 13, thereby obtaining uniform distribution by reducing the influence of the gravitational force on the refrigerant in the branch passage.

However, the first plate bodies 111, 112, 113, 114, and 115 and the second plate bodies 121, 122, 123, and 124 in the laminated header 2 according to the present invention are brazed with each other by using a clad material. Thus, when the first branch passage 11, the second branch passages 12, and the third branch passages 13 each have a small equivalent diameter D, brazing filler metal used in brazing enters into the passage and causes blockage and deformation of the passage, which leads to an ununiform distribution ratio.

To prevent deformation of each branch passage by the entering brazing filler metal, it is preferable to set the equivalent diameter D of the passage to be equal to or larger than 3 [mm]. The equivalent diameter D of a branch passage is calculated by Expression (4) below.

[Expression 4]

$$\text{Equivalent diameter } D = \frac{4 \times \text{Passage cross-sectional area}}{\text{Passage bench length}} \tag{4}$$

Thus, when the first branch passage 11, the second branch passages 12, and the third branch passages 13 each have the equivalent diameter D equal to or larger than 3 [mm] and the maximum passage cross-sectional area An [m$^2$] that satisfies Expression (3), uniform distribution of the refrigerant can be achieved in the laminated header 2 manufactured by brazing.

(Configurations of First Passage 10A, Second Passages 10B, and Third Passages 10C)

The following describes the configurations of the first passage 10A, the second passages 10B, and the third passages 10C.

The first passage 10A, the second passages 10B, and the third passages 10C function as inflow ports through which the refrigerant flows into the first branch passage 11, the second branch passages 12, and the third branch passages 13, respectively.

Having flowed into the first branch passage 11, the second branch passages 12, and the third branch passages 13 from the first passage 10A, the second passages 10B, and the third passages 10C, respectively, the refrigerant is agitated by colliding with an opposite wall surface formed by each branch passage. This agitation effect reduces the influence of the gravitational force on the liquid component of the refrigerant, thereby achieving uniform distribution of the refrigerant in each branch passage. When the flow speed of the refrigerant is so small that the liquid component of the refrigerant branches without colliding with the opposite wall surface, the influence of the gravitational force and inertial force on the liquid component is dominant enough to cause an ununiform distribution ratio.

Thus, when the first passage 10A, the second passages 10B, and the third passages 10C are each formed to have the equivalent diameter D equal to or smaller than the equivalent diameter D of a branch passage positioned further downstream, collision of a liquid film with the opposite wall surface is facilitated so that the agitation effect can be obtained.

<Modification of Shape of Branch Passage>

In Embodiment 1, the passage cross-sectional areas of the first branch passage 11, the second branch passages 12, and the third branch passages 13 are each constant and decrease in this order. However, the passage cross-sectional area of each branch passage may be gradually decrease toward the downstream side.

Figure 6:
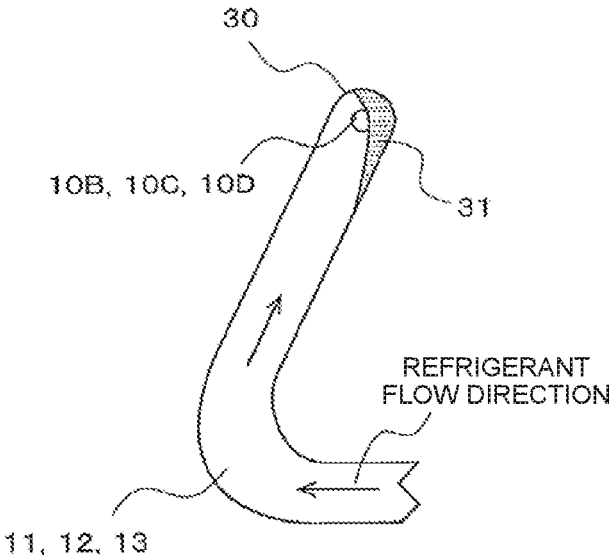
FIG. 6 is an enlarged view of a terminal part of a branch passage according to Embodiment 1.

FIG. 6 is an enlarged view of a terminal part of a branch passage according to Embodiment 1.

Figure 7:
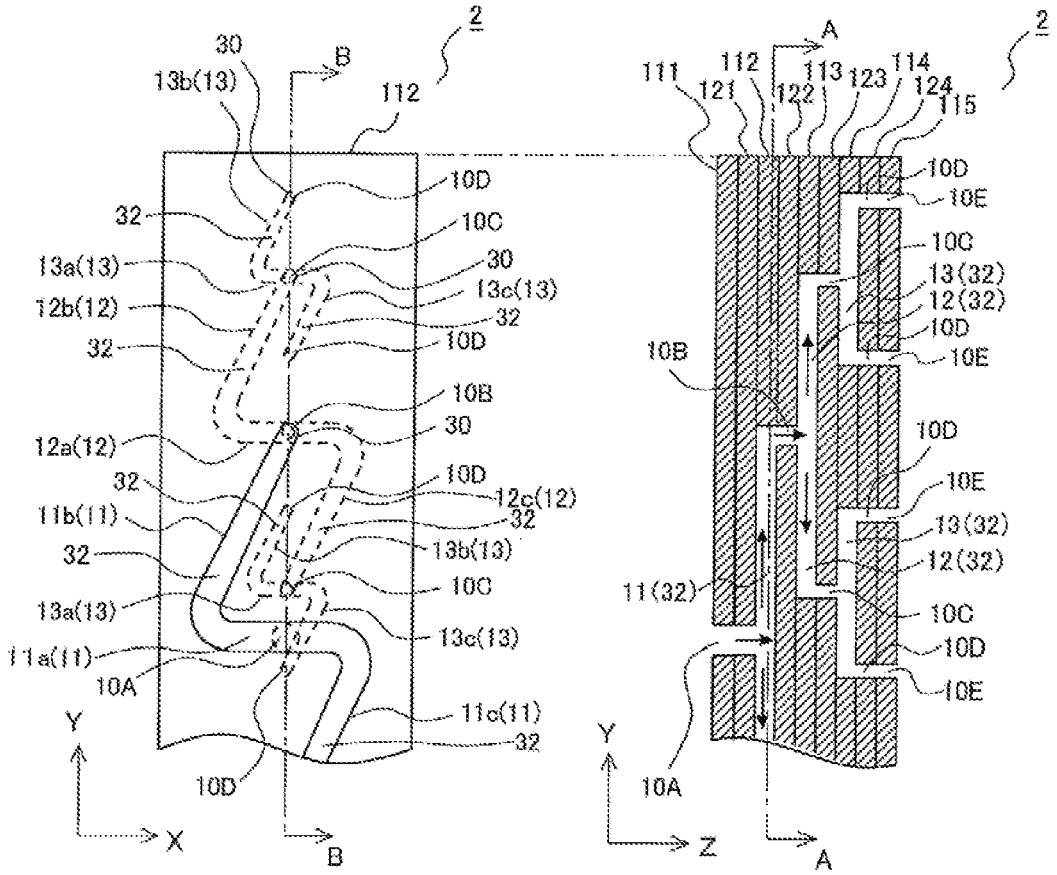
FIG. 7 is an A-A cross-sectional view and a B-B cross-sectional view of the laminated header, illustrating the structures of the branch passages according to a modification of Embodiment 1.

FIG. 7 is an A-A cross-sectional view and a B-B cross-sectional view of the laminated header 2, illustrating the structures of the branch passages according to a modification of Embodiment 1.

As described above, when the first passage 10A, the second passages 10B, and the third passages 10C according to Embodiment 1 are formed to have equivalent diameters D equal to or smaller than the equivalent diameters D of the first branch passage 11, the second branch passages 12, and the third branch passages 13, respectively, which are positioned downstream of the first passage 10A, the second passages 10B, and the third passages 10C, collision of a liquid film with the opposite wall surface is facilitated so that the agitation effect can be obtained.

Accordingly, as illustrated in FIG. 6, the equivalent diameters D of the second passages 10B, the third passages 100, and the fourth passages 10D are reliably smaller than the equivalent diameters D of the first branch passage 11, the second branch passages 12, and the third branch passages 13, respectively, which are positioned upstream of the equivalent diameters D of the second passages 10B, the third passages 100, and the fourth passages 10D. When these differences between the equivalent diameters D are large, a part where the passage cross-sectional area abruptly reduces is formed at a terminal part 30 of each branch passage in some cases. A liquid film 31 accumulates at this abrupt reduction part, preventing the flow of the refrigerant and causing an ununiform distribution ratio in the branch passage.

To prevent the accumulation of liquid refrigerant, a taper part 32 having a passage cross-sectional area that gradually reduces toward the downstream side is provided at the upper second branch part 11*b* of the first branch passage 11, the upper second branch part 12*b* of each second branch passage 12, and the upper second branch part 13*b* of each third branch passage 13 as illustrated in FIG. 7. With this configuration, the terminal part 30 of the first branch passage 11 is smoothly connected with the corresponding second passage 10B, the terminal part 30 of each second branch passage 12 is smoothly connected with the corresponding third passage 10C, and the terminal part 30 of each third branch passage 13 is smoothly connected with the corresponding fourth passage 10D.

Accordingly, accumulation of a liquid film in the terminal part 30 of each branch passage can be reduced, thereby achieving a uniform distribution ratio through the branch passage.

The taper part 32 may be provided only to the upper second branch part 11*b*, the upper second branch part 12*b*, and the upper second branch part 13*b* in this manner, or may be additionally provided to the lower second branch part 11*c*, the lower second branch part 12*c*, and the lower second branch part 13*c*. Uniform passage resistance can be achieved in the second branch part by providing the taper parts 32 at both sides of each of the upper and lower second branch parts, thereby obtaining a further uniform distribution ratio in each branch passage.

<Usage of Heat Exchanger 1>

The following describes exemplary usage of the heat exchanger 1 according to Embodiment 1.

The following description will be made on a case in which the heat exchanger 1 according to Embodiment 1 is used in an air-conditioning apparatus 50, but the present invention is not limited to such a case. For example, the heat exchanger 1 may be used in any other the refrigeration cycle device including a refrigerant cycle circuit. In addition, the following description will be made on a case in which the air-conditioning apparatus 50 is capable of switching between a cooling operation and a heating operation, but the present invention is not limited to such a case. The air-conditioning apparatus 50 may be capable of performing the cooling operation or the heating operation only.

Figure 8:
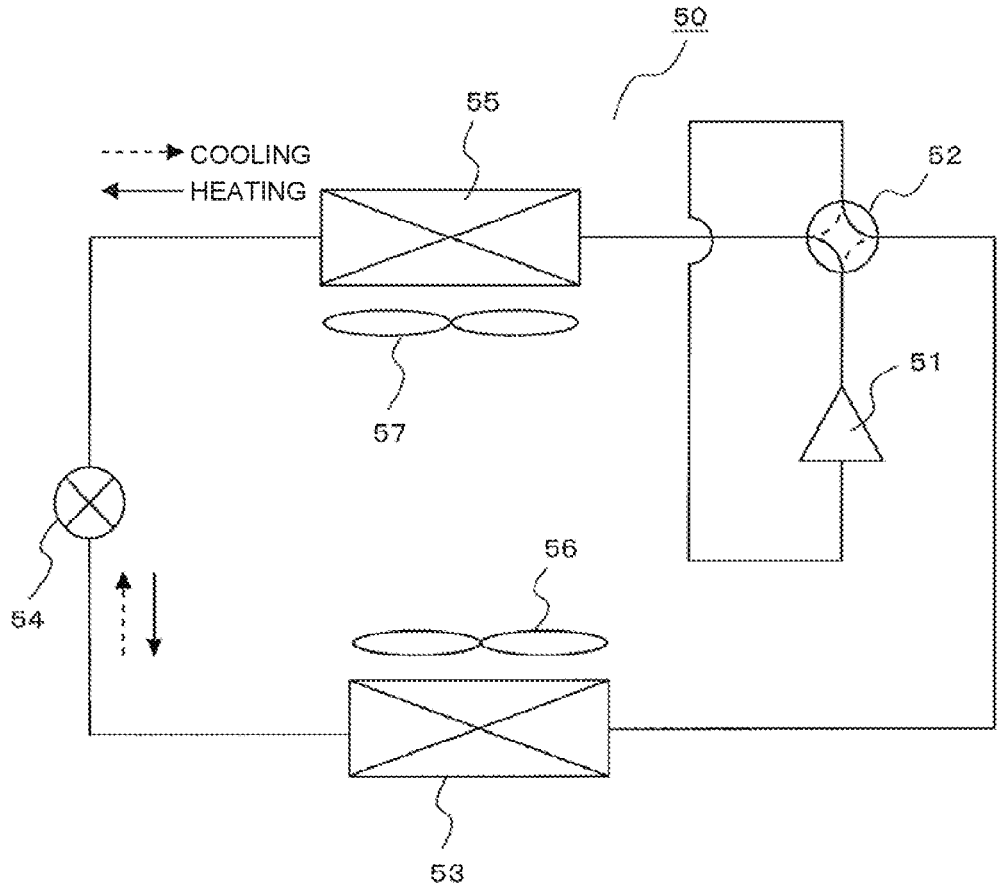
FIG. 8 is a diagram illustrating the configuration of an air-conditioning apparatus to which the heat exchanger according to Embodiment 1 is applied.

FIG. 8 is a diagram illustrating the configuration of an air-conditioning apparatus to which the heat exchanger according to Embodiment 1 is applied.

In FIG. 8, the flow of refrigerant at the cooling operation is indicated by an arrow illustrated with a dotted line, and the flow of the refrigerant at the heating operation is indicated by an arrow illustrated with a solid line.

As illustrated in FIG. 8, the air-conditioning apparatus 50 includes a compressor 51, a four-way valve 52, an outdoor heat exchanger (heat source side heat exchanger) 53, an expansion device 54, an indoor heat exchanger (load side heat exchanger) 55, an outdoor fan (heat source side fan) 56, an indoor fan (load side fan) 57, and a controller 58. The compressor 51, the four-way valve 52, the outdoor heat exchanger 53, the expansion device 54, and the indoor heat exchanger 55 are connected with each other through a refrigerant pipe to form a refrigerant cycle circuit.

The controller 58 is connected with, for example, the compressor 51, the four-way valve 52, the expansion device 54, the outdoor fan 56, the indoor fan 57, and various sensors. Switching is performed between the cooling operation and the heating operation when passages of the four-way valve 52 are switched by the controller 58.

The following describes the flow of the refrigerant at the cooling operation.

Having discharged from the compressor 51, the refrigerant in a high-pressure and high-temperature gas state flows into the outdoor heat exchanger 53 through the four-way valve 52, and condenses through heat exchange with air supplied by the outdoor fan 56. Having condensed into a high-pressure liquid state, the refrigerant flows out of the outdoor heat exchanger 53 and becomes a low-pressure two-phase gas-liquid state at the expansion device 54. The refrigerant in the low-pressure two-phase gas-liquid state flows into the indoor heat exchanger 55 and evaporates through heat exchange air supplied by the indoor fan 57, thereby achieving indoor cooling. Having evaporated into a low-pressure gas state, the refrigerant flows out of the indoor heat exchanger 55 and is sucked into the compressor 51 through the four-way valve 52.

The following describes the flow of the refrigerant at the heating operation.

discharged from the compressor 51, the refrigerant in a high-pressure and high-temperature gas state flows into the indoor heat exchanger 55 through the four-way valve 52 and condenses through heat exchange with air supplied by the indoor fan 57, thereby achieving indoor heating. Having condensed into a high-pressure liquid state, the refrigerant flows out of the indoor heat exchanger 55 and becomes a low-pressure two-phase gas-liquid state at the expansion device 54. The refrigerant in the low-pressure two-phase gas-liquid state flows into the outdoor heat exchanger 53 and evaporates through heat exchange with air supplied by the outdoor fan 56. Having evaporated into a low-pressure gas state, the refrigerant flows out of the outdoor heat exchanger 53 and is sucked into the compressor 51 through the four-way valve 52.

The heat exchanger 1 is used as at least one of the outdoor heat exchanger 53 and the indoor heat exchanger 55. When acting as an evaporator, the heat exchanger 1 is connected so that the refrigerant flows into through the laminated header 2 and flows out to the cylindrical header 3. In other words, when the heat exchanger 1 acts as an evaporator, the refrigerant in a two-phase gas-liquid state flows into the laminated header 2 through the refrigerant pipe and branches into the heat transfer tubes 4 of the heat exchanger 1. When the heat exchanger 1 acts as a condenser, the liquid refrigerant flows into the laminated header 2 through the heat transfer tubes 4 and joins together before flowing out to the refrigerant pipe.

<Effects>

(1) The laminated header according to Embodiment 1 includes: the first passage plate having a flat-plate shape in which the first passage 10A is formed; the second passage plate having a flat-plate shape in which the plurality of second passages 10B are formed; the third passage plate having a flat-plate shape in which the plurality of third passages 100 are formed; the first branch passage plate having a flat-plate shape in which the upstream side branch passage is formed, the upstream side branch passage branching the first passage 10A into the plurality of second passages 10B; and the second branch passage plate having a flat-plate shape in which the downstream side branch passage is formed, the downstream side branch passage branching one of the plurality of second passages 10B into the plurality of third passages 10C. The first passage plate, the first branch passage plate, the second passage plate, the second branch passage plate, and the third passage plate are stacked in this order. A first cross-sectional area as the maximum value of the passage cross-sectional area of the upstream side branch passage is larger than a second cross-sectional area as the maximum value of the passage cross-sectional area of the downstream side branch passage. With this configuration, the flow of the refrigerant decreases through branching into the branch passages, but a flow speed equal to or larger than a certain value can be maintained in each branch passage.

In other words, the flow speed of the refrigerant is increased by further reducing the passage cross-sectional area of a branch passage positioned further downstream while the maximum passage cross-sectional area of the branch passage is set to be equal to or smaller than the maximum passage cross-sectional area of a branch passage positioned upstream thereof. Accordingly, the influence of the gravitational force on the liquid component of the refrigerant can be reduced to prevent accumulation of a liquid film, thereby achieving a uniform distribution ratio through a branch passage.

(2) In the laminated header described above in (1), the minimum value of the equivalent diameter D of the upstream side branch passage and the minimum value of the equivalent diameter D of the downstream side branch passage are equal to or larger than a minimum defined value (for example, equal to or larger than 3 mm). With this configuration, ununiformity of the distribution ratio of the refrigerant can be prevented from being caused by blockage and deformation of each branch passage by brazing filler metal entering into the branch passage at brazing of plate bodies.

(3) In the laminated header described above in (1) or (2), the equivalent diameter D of the first passage 10A is equal to or smaller than the minimum value of the equivalent diameter D of the upstream side branch passage. With this configuration, the refrigerant having flowed into the upstream side branch passage from the first passage 10A is agitated through collision with the opposite wall surface. This agitation effect reduces the influence of the gravitational force on the liquid component of the refrigerant, thereby achieving uniform distribution of the refrigerant in the upstream side branch passage.

(4) In the laminated header described above in (1) to (3), the equivalent diameter D of the second passages 10B is equal to or smaller than the minimum value of the equivalent diameter D of the downstream side branch passage. With this configuration, the refrigerant having flowed into the downstream side branch passage from the second passages 10B is agitated through collision with the opposite wall surface. This agitation effect reduces the influence of the gravitational force on the liquid component of the refrigerant, thereby achieving uniform distribution of the refrigerant in the downstream side branch passage.

(5) In the laminated header described above in (1) to (4), a relation represented by Expression (5) below holds where An [$m^2$] represents the maximum passage cross-sectional area of the upstream side branch passage or the downstream side branch passage as a calculation target, Gr [kg/s] represents the minimum refrigerant flow flowing into the first passage 10A, n represents the number of branch passages branching upstream of the upstream side branch passage or the downstream side branch passage as a calculation target, $\rho_{ave}$ [$kg/m^3$] represents the saturated density of the refrigerant flowing into the first passage 10A, x represents the quality of the refrigerant flowing into the first passage 10A, $\rho_L$ [$kg/m^3$] represents the saturated liquid density of the liquid refrigerant flowing into the first passage 10A, and $\rho_G$ [$kg/m^3$] represents the saturated gas density of the gas refrigerant flowing into the first passage 10A. With this configuration, the flow speed of the refrigerant in the branch passage is equal to or larger than 0.3 [m/s]. Accordingly, the influence of the gravitational force on the liquid refrigerant can be reduced to prevent accumulation of a liquid film in the branch passage, thereby achieving uniform distribution of the refrigerant.

[Expression 5]

$$A_n \leqq \frac{Gr}{0.3\ n\rho_{ave}} = \frac{Gr}{0.3\ n}\left(\frac{x}{\rho_G} + \frac{1-x}{\rho_L}\right) \tag{5}$$

(6) In the laminated header described above in (1) to (5), the upstream side branch passage includes a first taper part having a passage cross-sectional area that gradually decreases toward a terminal end at a connection part with the corresponding second passage 10B. With this configuration, the terminal part 30 of the upstream side branch passage is smoothly connected with the second passage 10B. Accordingly, accumulation of a liquid film at the terminal part 30 of the branch passage can be reduced, thereby achieving a uniform distribution ratio through the branch passage.

(7) In the laminated header described above in (1) to (6), the downstream side branch passage includes a second taper part having a passage cross-sectional area that gradually decreases toward the terminal part 30 at a connection part with the corresponding third passage 10C. With this configuration, the terminal part 30 of the downstream side branch passage is smoothly connected with the third passage 10C. Accordingly, accumulation of a liquid film in the terminal part 30 of the branch passage can be reduced, thereby achieving a uniform distribution ratio through a branch passage.

(8) In the laminated header described above in (6), the upstream side branch passage includes the first branch part 11*a* extending in a substantially horizontal direction, the upper second branch part 11*b* extending upward in the direction of the gravitational force from one end of the first branch part, and the lower second branch part 11*c* extending downward in the direction of the gravitational force from the other end of the first branch part 11*a*, and at least the upper second branch part 11*b* includes the first taper part. With this configuration, accumulation of a liquid film can be reduced particularly at the terminal part of the upper second branch part 11*b* in which the influence of the gravitational force on the liquid refrigerant is large, thereby achieving a uniform distribution ratio through the branch passage.

(9) In the laminated header described above in (7), the downstream side branch passage includes the first branch part 12*a* extending in a substantially horizontal direction, the upper second branch part 12*b* extending upward in the direction of the gravitational force from one end of the first branch part 12*a*, and the lower second branch part 12*c* extending downward in the direction of the gravitational force from the other end of the first branch part 12*a*, and at least the upper second branch part 12*b* includes the first taper part. With this configuration, accumulation of a liquid film can be reduced particularly at the terminal part of the upper second branch part in which the influence of the gravitational force on the liquid refrigerant is large, thereby achieving a uniform distribution ratio through the branch passage.

Heat exchange capacity can be increased to improve cooling and heating performance by applying the laminated header described above in (1) to (9) to the heat exchanger 1 or the air-conditioning apparatus 50.

REFERENCE SIGNS LIST

1 heat exchanger 2 laminated header 2*a* distributing/joining passage

3 cylindrical header 3A first passage 3B second passage 4 heat transfer tube 5 holder 6 fin 10A first passage 10B second passage 100 third passage 10D fourth passage 10E fifth passage 11 first branch passage 11*a* first branch part 11*b* upper second branch part 11*c* lower second branch part 12 second branch passage 12*a* first branch part 12*b* upper second branch part 12*c* lower second branch part 13 third branch passage 13*a* first branch part 13*b* upper second branch part 13*c* lower second branch part 20 branch passage

21 upper branch part 22 liquid film 30 terminal part 31 liquid film

32 taper part 50 air-conditioning apparatus 51 compressor 52 four-way valve 53 outdoor heat exchanger 54 expansion device 55 indoor heat exchanger 56 outdoor fan 57 indoor fan 58 controller, 111, 112, 113, 114, 115 first plate body, 121, 122, 123, 124 second plate body, An maximum passage cross-sectional area, D equivalent diameter, Vm average flow speed

The invention claimed is:

1. A laminated header comprising:

a first passage plate having a flat-plate shape in which a first passage is formed;

a second passage plate having a flat-plate shape in which a plurality of second passages are formed;

a third passage plate having a flat-plate shape in which a plurality of third passages are formed;

a first branch passage plate having a flat-plate shape in which an upstream side branch passage is formed, the upstream side branch passage branching the first passage into the plurality of second passages; and a second branch passage plate having a flat-plate shape in which a downstream side branch passage is formed, the downstream side branch passage branching each one of the plurality of second passages into the plurality of third passages, the first passage plate, the first branch passage plate, the second passage plate, the second branch passage plate, and the third passage plate being stacked in this order, wherein a maximum passage cross-sectional area of the upstream side branch passage, and each of the downstream side branch passages, respectively, decreases in this order, the upstream side branch passage including a first taper part, the upstream side branch passage being a part of a flow passage that extends from an inlet of the first passage to an outlet of the third passage, wherein the upstream side branch passage includes (a) a first branch part communicating with the first passage, the first branch part including ends, (b) an upper second branch part that extends upward from one of the ends of the first branch part, and (c) a lower second branch part that extends downward from another one of the ends of the first branch part, the first taper part is formed at least at the upper second branch part which extends upward in the direction of gravitational force, the first taper part having a passage cross-sectional area defined by an inner peripheral wall of the first taper part, the passage cross-sectional area being gradually decreasing downstream along a longitudinal direction of the upper second branch part to a terminal end at a connection part with one passage of the plurality of second passages, wherein an accumulation of liquid refrigerant in the terminal end before flowing into the connection part of the one passage of the plurality of second passages is prevented, and wherein a diameter of the first passage is smaller than a minimum value of a diameter of the upstream side branch passage, and a diameter of the second passage is smaller than a minimum value of a diameter of the downstream side branch passage.

2. The laminated header of claim 1, wherein a minimum value of a diameter of the upstream side branch passage and a minimum value of a diameter of the downstream side branch passage are equal to or larger than a minimum defined value.

3. The laminated header of claim 1, wherein Relational Expression (1) below holds

[Expression 1]

$$A_n \leqq \frac{Gr}{0.3\ n\rho_{ave}} = \frac{Gr}{0.3\ n}\left(\frac{x}{\rho_G} + \frac{1-x}{\rho_L}\right) \qquad \text{Relational Expression (1)}$$

where An [$m^2$] represents a maximum passage cross-sectional area of the upstream side branch passage or the downstream side branch passage, Gr [kg/s] represents a minimum refrigerant flow flowing into the first passage, n represents the number of branch passages branching upstream of the upstream side branch passage or the downstream side branch passage, $\rho_{ave}$ [$kg/m^3$] represents the saturated density of refrigerant flowing into the first passage, x represents the quality of the refrigerant flowing into the first passage, $\rho_L$ [$kg/m^3$] represents the saturated liquid density of liquid refrigerant flowing into the first passage, and $\rho_G$ [$kg/m^3$] represents the saturated gas density of gas refrigerant flowing into the first passage.

4. The laminated header of claim 1, wherein the downstream side branch passage includes a second taper part having a passage cross-sectional area defined by an inner peripheral wall of the second taper part, wherein the passage cross-sectional area of the second taper part is gradually decreasing downstream along a longitudinal direction of the second branch part to a terminal end at a connection part with one passage of the plurality of third passages.

5. The laminated header of claim 4, wherein the downstream side branch passage includes a first branch part extending in a horizontal direction, an upper second branch part extending upward in the direction of gravitational force from one end of the first branch part of the downstream side branch passage, and a lower second branch part extending downward in the direction of gravitational force from the other end of the first branch part of the downstream side branch passage, and the second taper part is formed at least at the upper second branch part.

6. A heat exchanger comprising the laminated header of claim 1 and a plurality of heat transfer tubes, wherein the plurality of heat transfer tubes are connected with the laminated header.

7. An air-conditioning apparatus comprising the heat exchanger of claim 6.

8. A laminated header comprising:

a first passage plate having a flat-plate shape in which a first passage is formed;

a second passage plate having a flat-plate shape in which a plurality of second passages are formed;

a third passage plate having a flat-plate shape in which a plurality of third passages are formed;

a first branch passage plate having a flat-plate shape in which an upstream side branch passage is formed, the upstream side branch passage branching the first passage into the plurality of second passages; and a second branch passage plate having a flat-plate shape in which a downstream side branch passage is formed, the downstream side branch passage branching one of the plurality of second passages into the plurality of third passages, the first passage plate, the first branch passage plate, the second passage plate, the second branch passage plate, and the third passage plate being stacked in this order, the upstream side branch passage including a first taper part, wherein the upstream side branch passage includes (a) a first branch part communicating with the first passage, the first branch part including ends, (b) an upper second branch part that extends upward from one of the ends of the first branch part, and (c) a lower second branch part that extends downward from another one of the ends of the first branch part, and the first taper part is formed at least at the upper second branch part which extends upward in the direction of gravitational force, the first taper part having a passage cross-sectional area defined by an inner peripheral wall of the first taper part, the passage cross-sectional area being gradually decreasing downstream along a longitudinal direction of the upper second branch part to a terminal end at a connection part with one passage of the plurality of second passages, wherein an accumulation of liquid refrigerant in the terminal end before flowing into the connection part of the one passage of the plurality of second passages is prevented, wherein a first cross-sectional area as a maximum value of the passage cross-sectional area of the upstream side branch passage is larger than a second cross-sectional area as a maximum value of a passage cross-sectional area of the downstream side branch passage, and wherein a diameter of the first passage is smaller than a minimum value of a diameter of the upstream side branch passage, and a diameter of the second passage is smaller than a minimum value of a diameter of the downstream side branch passage.

9. The laminated header of claim 8, wherein a minimum value of a diameter of the upstream side branch passage and a minimum value of a diameter of the downstream side branch passage are equal to or larger than a minimum defined value.

10. The laminated header of claim 8, wherein Relational Expression (1) below holds

[Expression 1]

$$A_n \leqq \frac{Gr}{0.3n\rho_{ave}} = \frac{Gr}{0.3n}\left(\frac{x}{\rho_G} + \frac{1-x}{\rho_L}\right) \quad \text{Relational Expression (1)}$$

where An [$m^2$] represents a maximum passage cross-sectional area of the upstream side branch passage or the downstream side branch passage, Gr [kg/s] represents a minimum refrigerant flow flowing into the first passage, n represents the number of branch passages branching upstream of the upstream side branch passage or the downstream side branch passage, $\rho_{ave}$ [$kg/m^3$] represents the saturated density of refrigerant flowing into the first passage, x represents the quality of the refrigerant flowing into the first passage, $\rho_L$ [$kg/m^3$] represents the saturated liquid density of liquid refrigerant flowing into the first passage, and $\rho_G$ [$kg/m^3$] represents the saturated gas density of gas refrigerant flowing into the first passage.

11. The laminated header of claim 8, wherein the downstream side branch passage includes a second taper part having a passage cross-sectional area defined by an inner peripheral wall of the second taper part, wherein the passage cross-sectional area of the second taper part is gradually decreasing downstream along a longitudinal direction of the second branch part to a terminal end at a connection part with one passage of the plurality of third passages.

12. The laminated header of claim 11, wherein the downstream side branch passage includes a first branch part extending in a horizontal direction, an upper second branch part extending upward in the direction of gravitational force from one end of the first branch part of the downstream side branch passage, and a lower second branch part extending downward in the direction of gravitational force from the other end of the first branch part of the downstream side branch passage, and the second taper part is formed at least at the upper second branch part of the downstream side branch passage.

13. A heat exchanger comprising the laminated header of claim 8 and a plurality of heat transfer tubes, wherein the plurality of heat transfer tubes are connected with the laminated header.

14. An air-conditioning apparatus comprising the heat exchanger of claim 13.

15. The laminated header of claim 1, further comprising:

a third branch passage plate having a flat-plate shape in which a further downstream side branch passage is formed, the further downstream side branch passage branching each one of the plurality of third passages into a plurality of fourth passages, the first passage plate, the first branch passage plate, the second passage plate, the second branch passage plate, the third passage plate, and the third branch passage plate being stacked in this order, wherein the maximum passage cross-sectional area of the upstream side branch passage, and each of the downstream side branch passages, and each of the further downstream side branch passages, respectively, decreases in this order.

16. The laminated header of claim 8, further comprising:

a third branch passage plate having a flat-plate shape in which a further downstream side branch passage is formed, the further downstream side branch passage branching each one of the plurality of third passages into a plurality of fourth passages, the first passage plate, the first branch passage plate, the second passage plate, the second branch passage plate, the third passage plate, and the third branch passage plate being stacked in this order, wherein the second cross-sectional area is larger than a third cross-sectional area as a maximum value of a passage cross-sectional area of the further downstream side branch passage.

* * * * *